United States Patent [19]

Jungermann et al.

[11] Patent Number: 4,839,080

[45] Date of Patent: Jun. 13, 1989

[54] ANTIBACTERIAL IODOPHOR SOAP BASE COMPOSITION AND METHOD OF MAKING SAME

[75] Inventors: Eric Jungermann, Phoenix, Ariz.; Richard A. Scott, Burbank, Calif.

[73] Assignee: Neutrogena Corporation, Los Angeles, Calif.

[21] Appl. No.: 44,220

[22] Filed: Apr. 30, 1987

[51] Int. Cl.[4] ..... C11D 9/06; C11D 9/50; C11D 9/60; C11D 13/60

[52] U.S. Cl. ..... 252/107; 252/106; 252/117; 252/118; 252/132; 252/134; 252/174; 252/DIG. 5; 252/DIG. 16; 514/5

[58] Field of Search ..... 252/107, 106, 134, 174, 252/DIG. 16, DIG. 5, 117, 121; 514/5

[56] References Cited

U.S. PATENT DOCUMENTS

| | | | |
|---|---|---|---|
| 3,932,655 | 1/1976 | Conn | 424/317 |
| 4,045,364 | 8/1977 | Richter | 252/106 |
| 4,130,640 | 12/1978 | Chazan | 424/80 |
| 4,188,306 | 2/1980 | Dillarstone | 252/121 |
| 4,207,198 | 6/1980 | Kenkare | 252/117 |
| 4,290,904 | 9/1981 | Poper | 252/118 |
| 4,387,217 | 6/1983 | Schmolka | 528/417 |
| 4,603,005 | 7/1986 | Chanssee | 252/174.24 |
| 4,617,148 | 10/1986 | Shields | 252/547 |
| 4,673,525 | 6/1987 | Small | 252/132 |
| 4,692,261 | 9/1987 | Filomeno | 252/105 |

*Primary Examiner*—Dennis Albrecht
*Assistant Examiner*—Kathlene Markowski
*Attorney, Agent, or Firm*—Richard R. Mybeck

[57] ABSTRACT

An antibacterial soap composition and method of making the same in which the product is especially useful for wound cleansing, pre-operative cleansing of surgical sites, sanitizing, surgical scrubbing and the like containing an iodophore as its essential bacteriostat. The iodophore selected from the group consisting of povidone-iodine, polyvinylpyrrolidone-iodine ("PVP-iodine") and the like, is disposed in a unique soap base which is characterized by its remarkable compatibility with iodophores. This soap base is predicated upon saturated fatty acids such as isostearic acid, dodecanoic acid and the like and obtains a degree of iodophore stability which has heretofore been obtainable only in detergent-base formulations. The deleterious side effects of detergent materials are eliminated. Both bars and liquid soaps are described.

6 Claims, No Drawings

ANTIBACTERIAL IODOPHOR SOAP BASE COMPOSITION AND METHOD OF MAKING SAME

INTRODUCTION

The present invention pertains to an antibacterial soap composition specially useful as a surgical scrub, for wound cleansing, pre-operative cleansing of surgical sites, and sanitizing, to methods of preparing the composition and the novel soap base therein. The composition is based on a unique soap base which is uniquely compatible with iodophores such as povidone-iodine and the like and therefore is capable of employing iodine as the active germicidal agent therewithin while avoiding the deleterious side effects of the detergent bases heretofore required for in the use of iodophore bacteriostats.

BACKGROUND OF INVENTION

While iodine has heretofore been widely recognized as a highly effective germicide, it has not been previously possible to prepare a soap-based surgical scrub in which iodine can be used because of the reaction which readily occurs between iodine and regular soap bases, that are usually made from tallow, coconut oil, oleic acid, palm oil, palm kernel oil and the like.

While such a reaction is obviously disadvantageous for purposes of preparing a soap-based antiseptic solution containing iodine, it has for many years provided a major method for determining the unsaturation in a fat, oil or cosmetic ingredient which is reported as the "iodine value" (See: U.S. Pat. No. XXI, 1201). In this reaction, free iodine combines in a stoichiometric reaction with unsaturated double bonds, i.e., an iodine molecule reacts with one double bond. Because of this well known reaction and because iodophores, in aqueous solution, releases free iodine ($I^-$) for reaction with unsaturated bonds to form a non-germicidal iodide, the industry has been led away from any attempt to develop a soap-based product incorporating iodophores. Indeed the Federal Register, Vol. 43, No.4, Friday, Jan. 6, 1978, p.1236 states that "Neither the Commissioner nor the panel was presented any data to show that iodine (elemental) or iodophores can be formulated into antimicrobial soaps".

Instead, the art was forced to deliver iodine in dilute aqueous solutions and the iodine-containing surgical scrubs had to be formulated with synthetic detergents, i.e., saturated surfactants which can be relatively harsh on human skin. Representative of such detergents are: polyoxyethylene-9-octyl phenyl ether (CTFA name, "Octoxynol-9"; TRITON-X100), and sodium lauryl sulfate, sodium lauryl ether sulfate, and sodium olefin sulfonates.

The marked disadvantages of the detergent systems, especially when applied to tender and wounded areas of the human body, has been well documented (See: "Comparison of Detergent Based Versus Soap Based Liquid Soaps" by D. W. Dyer and T. Hassapis, *Soap/-Cosmetics/Chemical Specialties,* July, 1983).

Other antimicrobial agents have been tried in soap and detergent bases with some success, but still many problems remain. For instance, cationic quaternary ammonium compounds are incompatible with anionic surfactants such as soaps. Hexachlorophene was an outstanding germicide and served the health care industry well for many years, but in 1972 was limited to use in prescription products. Other antimicrobials used in bar soaps include 3,4,4'trichlorocarbanilide (TCC); 3,4',5-tribromosalicylanilide (TBS); 4,4'-dichloro-3'-(trifluoromethyl) carbanilide; and 2-hydroxy 2', 4,4'-trichlorodiphenyl ether ("Irgasan DP-300" or "Triclosan"). However, in the early 1970's the U.S. Food and Drug Administration removed both hexachlorophene and TBS from the general market. Presently only two antimicrobial agents are successfully used in soaps, viz, TCC and Irgasan. TCC is used only in bar soaps because it is too insoluble and unstable for formulation in liquid soaps such as surgical scrubs.

The present invention thus provides a highly effective antibacterial soap composition which delivers iodine as the active germicide to the desired site in a novel soap base which enables the user to obtain the beneficial mildness of a soap base vis-a-vis the harsher detergent bases heretofore required, while simultaneously realizing the decided germicidal advantages of an iodophore.

SUMMARY OF THE INVENTION

The present invention is predicated upon the discovery of a novel soap base which is compatible with iodophores and thereby permits the formulation of a unique and improved antibacterial soap composition which obtains the mildness of fatty acid soaps while maintaining iodophore levels heretofore obtained only with detergent based systems. The importance of this accomplishment is reflected by the fact that iodophores such as povidone-iodine, polyvinylpyrrolidone iodine ("PVP-iodine") and the like, are not merely bacteriostatic, they are also microbicidal and as such kill both gram-positive and gram-negative bacteria (including antibiotic resistant strains), fungi, viruses, protozoa and yeasts.

Accordingly, it is a principal object of the present invention to provide a new and improved antibacterial soap composition containing effective amounts of iodophores.

Another principal object of the present invention is to provide a new and improved soap base for preparing surgical scrubs and the like which are compatible with iodine, an iodophore, and maintain germicidal iodine therewithin without interraction or degradation thereof.

Another object of the present invention is to provide a novel and unique soap base having no long chain unsaturated molecules therewith which would if present react with iodophores and destroy the germicidal effectiveness thereof.

A further object of the present invention is to provide a new and improved process for producing a mild soap base with good foaming and cleansing properties having no long chain unsaturated molecules therein by suspending a mixture of highly purified saturated fatty acids and saturated branched acids in water with selected antioxidants and chelating agents and thereafter neutralizing the suspension with a precise amount of sodium hydroxide at a temperature of 60°-65° C., adding other additives and cooling the neutralized suspension to a temperature of 40° C., and adjusting the pH of the cooled neutralized suspension with the addition of citric acid to 8.6-8.8.

These and still further objects as shall hereinafter appear are readily fulfilled by the present invention in a remarkably unexpected manner as will be readily discerned from the following detailed description of an exemplary embodiment thereof.

DESCRIPTION OF THE PREFERRED EMBODIMENTS

In accordance with the present invention, an antibacterial soap composition especially useful for wound cleansing, pre-operative cleansing of surgical sites, sanitizing, and as a surgical scrub is prepared containing the following ingredients in the ranges (in weight percent) shown in Table A below.

TABLE A

| Ingredient | (Wt/Wt) % |
|---|---|
| DI Water | 40.0–50.0 |
| EDTA ($Na_3$) | 0.5–0.15 |
| HEEDTA | 0.1–0.3 |
| BHA | 0.5–1.0 |
| BHT | 0.5–1.0 |
| Isostearic acid | 4.0–8.0 |
| n-Dodecanoic acid | 3.0–10.0 |
| Stearic acid | 1.0–5.0 |
| Caustic soda (50%) | 2.3–3.70* |
| Triethanolamine | 2.0–4.0 |
| Sodium N—Methyl taurate | 1.0–5.0 |
| Lauric DEA | 1.0–5.0 |
| Sodium lauroyl sarcosinate | 1.0–5.0 |
| Glycerine | 5.0–15.0 |
| Citric acid | q.s. (obtain pH = 8.6–8.8) |
| PVP-Iodine | 6.0–10.0 |

*Stoichiometric amount dependent on total fatty acid used.

In the foregoing and hereafter, DI Water identifies "distilled water"; EDTA ($Na_3$) identifies "trisodium salt of ethylene diaminotetraacetic acid"; HEEDTA identifies "hydroxy ethylene diaminotetraacetic acid"; BHA identifies "butylated hydroxyanisole"; BHT identifies "butylated hydroxytoluene"; Lauric DEA identifies "lauric diethanolamide"; and PVP-Iodine identifies "polyvinylpyrrolidone-iodine". Isostearic Acid is a mixture of $C_{18}H_{36}O_2$ fatty acids (Octadecanoic Acid).

In one practice of the present invention, 6.0 parts (Wt/Wt) isostearic acid, 5.0 parts n-dodecanoic acid, and 3.0 parts stearic acid are heated to 60° C. and mixed with 3.7 parts caustic soda (50%) to neutralize the acids. Next, 2.1 parts of a suitable solubilizer such as triethanolamine ("TEA") is stirred therein with the further addition of 43.4 parts of distilled water and the entire contents of the vessel are heated for 30 minutes at 60° C.

After heating the contents for thirty minutes, 4.0 parts sodium N-methyl taurate, 4.0 parts lauric diethanolamide, 4.0 parts sodium lauroyl sarcosinate and 15.0 parts glycerine are stirred into the heated mixture, followed by 0.2 parts of a suitable chelating agent such as hydroxy ethyl ethylene diaminotetraacetic acid ("HEEDTA") and 0.1 parts of ethylene diaminotetraacetic acid (sodium) ("EDTA ($Na_3$"). The stirred contents of the vessel are then cooled to 40° C. To the cooled contents, sufficient citric acid is added to adjust the pH to the range between about 8.6 and about 8.8 which is followed by the addition of 8.0 parts polyvinylpyrrolidone-iodine (povidone-iodine) which is thoroughly mixed therewithin. Thereafter finished mixture containing about 100 parts as described, is ready for packaging.

The composition produced by the procedure described above demonstrates a shelf life of 18–24 months and passes the Basic Antiseptic Challenge Test (See: Weber and Black, American Journal of Public Health 38, pp. 1405–17 (1949) for a complete description of the protocol).

The key to the present invention is believed to lie in the creation of a mild soap base having good foaming and cleansing properties from long chain fatty acids which have no unsaturated bonds therein thereby avoiding the diversion of free iodine from its active role into ineffectual iodides which occurs when unsaturated fatty acids are used.

Another important ingredient to the composition of the present invention is the solubilizers such as triethanolamine, diethanolamide, ethanolamine and the like which are deployed in the total formulation in an amount from about 2 to about 4 percent by weight.

An emollient, such as glycerine, propylene glycol, hexylene glycol, derivatives of lanolin and the like is included to enhance the skin quality of the total formulation. The emollient is deployed in an amount ranging from about 5 to about 15 weight percent based on the total weight of the composition.

Other optional ingredients for addition into the principal formulation of the surgical scrub herein described and illustrated include sodium -methyl taurate which, when used in an amount up to 5 weight percent of the total blend, functions as a lime soap dispersant; lauric DEA which, when used in an amount up to 5 weight percent of the total blend, functions as a foam stabilizer; sodium lauroyl sarcosinate, when used in an amount up to 5 weight percent of the total blend, functions as a mild surfactant; and glycerine when used in an amount up to 20 weight percent of the total blend, functions as a humectant and as a solubilizer. As will hereinafter appear, each is added with the overall process with stirring and incorporated thereby into the homogeneous blend produced therefrom.

The chelating agent deployed herein is, preferably, either ethylene diaminotetraacetic acid or the alkali metal salts thereof such as trisodium ethylene diaminotetraacetate. Other useful additive compounds include the sugar acids or alkali metal salts of gluconic acid, lactic acid, citric acid, and the like.

The antibacterial soap solution of the present invention has been found to be effective in killing off both gram-negative and gram-positive bacteria and fungi such as, pseudomonas aeruginosa, staphylococcus aureus, salmonella choleraesius, escherichia coli and other similar microbial contaminants. Thus, the solutions are useful as effective disinfectants in hospitals, clinics, nursing homes, for cleaning dietary utensils, in industrial food processing plants and institutions, as an algae growth inhibitor, as a surgical scrub, skin cleaner, pre-operative prep and the like.

In one practice of the present invention an antibacterial soap composition is prepared by admixing 4 to 8 W/W percent of isostearic acid, 3 to 10 W/W percent of n-dodecanoic acid, and from 1 to 5 W/W percent of stearic acid in a vessel heated to 60° C. with a stoichiometric amount of an alkali selected from the group consisting of caustic soda or sodium hydroxide until the acids are balanced therewith; and stirring from 2 to 4 W/W percent of TEA as solubilizer into the heated balanced mixture while adding from 40 to 50 W/W percent distilled water thereto. The balanced solubilized water mixture is then cooked with stirring for 30 minutes at 60° C. to produce a homogeneous cooked mixture to which is then added from about 1 to 5 W/W percent sodium N-methyl taurate, from about 1 to 5 W/W percent lauric DEA, from about 1 to 5 percent sodium lauroyl sarcosinate, and about 5 to 15 W/W percent glycerine while stirring continues. Thereafter, about 0.3 W/W percent of a chelating agent and about 1.0 W/W percent of an antioxidant is added thereto with continuous stirring to form a homogeneous blend which is then cooled with continuing stirring to 40° C. From about 6.0 to 10.0 W/W percent of an iodophore is then added to the cooled blend; with stirring, followed by incremental additions of citric acid until the pH of the blend is brought into the range of 8.6 to 8.8. The pH adjusted blend is then ready for packaging.

To provide a more complete understanding of the present invention and not by way of limitation, reference is made to the following examples.

EXAMPLE I

An antibacterial soap solution having the below list formulation was prepared according to the present invention

| Ingredient | Wt/Wt percent |
|---|---|
| Isostearic acid | 6.0 |
| n-Dodecanoic acid (Lauric) | 5.0 |
| Stearic acid* | 3.0 |
| Caustic soda | 3.7 |
| Triethanolamine (TEA) | 2.1 |
| Distilled water | 43.4. |
| Sodium N—methyl taurate | 4.0 |
| Lauric DEA | 4.0 |
| Sodium lauroyl sarcosinate | 4.0 |
| Glycerine | 15.0 |
| HEEDTA | 0.2 |
| EDTA ($Na_3$) | 0.1, |
| BHA | 0.5 |
| BHT | 0.5. |
| Povidone-iodine | 8.0 |
| Citric acid | 0.5. |

*Commercial grade Stearic acid contains 70–80% Stearic acid and 20–30% Palmitic acid.

In a container, the acids, caustic soda and a solubilizer are introduced and thoroughly mixed while the distilled water is added at room temperature. The temperature of the mixture is then raised to 60°–65° C. and the entire blend is stirred for thirty minutes. Thereafter, the sodium-N-methyl taurate, lauric DEA, sodium lauroyl sarcosinate, glycerine, HEEDTA, EDTA ($Na_3$), BHA and BHT are added with continued stirring and the blend is cooled to 40° C. Povidone-iodine is added followed by q.s. citric acid to produce a pH of 8.6 to 8.8.

Upon attaining the desired pH using incremental additions of citric acid with intermediate testing, the formulation was complete.

EXAMPLE II

A liquid soap prepared according to Example I was subjected to a Soap Chamber Test (See: "The Soap Chamber Test", Peter J. Frosch, M.D. et al, Journal of American Academy of Dermatology, Vol. 1, No. 1 pp 35–41, (1979) for definition of protocol) and compared against a detergent solution with and without antiseptic. The active detergent employed for comparison testing was polyoxyethylene-9-octyl pehenyl ether (available as Triton X-100; CTFA name "Oxytoxynol-9") and the antiseptic used was PVP-iodine. The Soap Chamber Test is a recognized and generally accepted method for determining the irritancy of cleaning products. The lower the total score, the less irritating the product. The results of The Soap Chamber Test are shown in TABLE B, below.

TABLE B

| Test Sample | Ery-thema | Scaling | Fissuring | Total |
|---|---|---|---|---|
| EXAMPLE I | 0.1 | 0.0 | 0.0 | 0.1 |
| Octoxynol-9 (CTFA name) | 1.2 | 0.7 | 0.0 | 1.9 |
| PVP-iodine/Octoxynol-9 solution | 1.8 | 1.0 | 0.5 | 3.3 |

EXAMPLE III

A stability test was conducted by preparing a first sample containing Povidone-iodine 10% in a standard soap base (tallow:coconut(80:20)), a second sample using the formulation prepared by the procedure of Example I (containing no unsaturated fatty acids), and a third sample containing povidone-iodine 10% in Octoxynol-9 denominated a standard detergent system. The formulations were tested for povidone-iodine levels using conventional test procedures at 24 hours, 48 hours, 7 days, 30 days and 90 days. The results of these measurements are reported in TABLE C below.

TABLE C

| | POVIDONE-IODINE LEVEL | | |
|---|---|---|---|
| Time | Standard Soap base | EX. 1 soap base | Detergent base |
| Theoretical | 1.00% | 1.00% | 1.00% |
| 24 hours | 0.37% | 0.96% | 0.97% |
| 48 hours | 0.14% | 0.96% | 0.96% |
| 7 days | 0.00% | 0.96% | 0.95% |
| 30 days | 0.00% | 0.94% | 0.95% |
| 90 days | 0.00% | 0.94% | 0.94%. |

The data readily demonstrates that povidone-iodine is readily decomposed in and by the standard soap system whereas the improved soap base of the present invention and the detergent based system obtain substantially equivalent povidone-iodine stability characteristics. Thus the germicidal benefit of a detergent based product can now be realized without incurring the harsh side effect of the detergent based material.

EXAMPLE V–IX

The procedure of Example I was repeated using the various compositions shown in TABLE D, below. Each preparation when finished was subjected to the comparative tests as described in EXAMPLES II and III and, without exception, obtained the similar results shown for the formulation of EXAMPLE I.

TABLE D

| Example No. | IV | V | VI | VII | VIII | IX |
|---|---|---|---|---|---|---|
| Ingredient | (W/W percent) | | | | | |
| Isostearic acid | 6.0 | 6.0 | 4.0 | 8.0 | 8.0 | 6.0 |
| n-Dodecanoic acid (L) | 5.0 | 5.0 | 3.0 | 10.0 | 10.0 | 5.0 |
| Stearic acid | 3.0 | 3.0 | 1.0 | 5.0 | 5.0 | 3.0 |
| Caustic soda | 3.7 | 3.7 | 2.1 | 5.0 | 5.0 | 3.7 |
| TEA | 2.1 | 2.1 | 2.1 | 4.0 | 4.0 | 2.1 |
| DI water | 48.4 | 40.0 | 50.0 | 41.7 | 41.7 | 45.9 |
| Na N—methyl taurate | 4.0 | 4.0 | 4.0 | 1.0 | 1.0 | 5.0 |
| Lauric DEA | 4.0 | 3.0 | 3.5 | 4.0 | 1.0 | 5.0 |
| Sodium lauroyl sarcosinate | 4.0 | 4.0 | 4.0 | 2.0 | 1.0 | 5.0 |
| Glycerine | 10.0 | 20.0 | 15.0 | 10.0 | 20.0 | 10.0 |
| HEEDTA | 0.2 | 0.3 | — | 0.3 | 0.2 | 0.2 |
| EDTA ($Na_3$) | 0.1 | — | 0.3 | — | 0.1 | 0.1 |
| BHA | 0.5 | 0.5 | 1.0 | — | 0.5 | 0.5 |
| BHT | 0.5 | 0.5 | — | 1.0 | 0.5 | 0.5 |
| Iodophore | 8.0 | 8.0 | 10.0 | 8.0 | 6.0 | 8.0 |
| Citric acid | q.s. | q.s. | q.s. | q.s. | q.s | q.s. |
| pH | 8.7 | 8.6 | 8.7 | 8.8 | 8.7 | 8.6 |

EXAMPLE X

An effective antibacterial bar soap having the below listed formulation was prepared according to the present invention to produce a thick homogeneous blend which is poured into frames, cooled and thereafter cut into bars.

| Ingredient | Wt/Wt percent |
|---|---|
| Triethanolamine | 33.4% |
| Hydrogenated tallow | 14.25 |
| Isostearic acid | 20.5 |
| Caustic soda | 8.1 |
| DI Water | 6.2 |
| Coco DEA | 3.5 |
| Glycerine | 10.0 |
| α-Tocopherol | .05 |
| Povidone-Iodine | 4.0 |

The bar was found to obtain effective results when used both as a bacteriostat and as an antimicrobial.

From the foregoing it becomes readily apparent that a new and unique germicidal soap composition and methods of producing the same have been herein described and illustrated which fulfill all of the aforestated objectives in a remarkably unexpected fashion. It is of course understood that such modifications, alterations and adaptations as will readily occur to the artisan confronted with this disclosure are intended within the spirit of the present invention which is limited only by the scope of the claims appended hereto.

Accordingly, what is claimed is:

1. An antibacterial soap composition capable of delivering iodophores as its active germicide while providing the gentleness of fatty acid soaps consisting essentially of, in weight percent: from about 4.0 percent to about 8.0 percent of isostearic acid; from about 3.0 percent to about 10.0 percent of n-dodecanoic acid; from about 1.0 percent up to about 5.0 percent stearic acid; from about 2.1 percent up to about 5.0 percent caustic soda (50%); from about 2.1 percent up to about 4.0 percent triethanolamine; from about 40 percent up to about 50 percent distilled DI water; from about 1.0 percent up to about 5.0 percent sodium N-methyl taurate; from about 1.0 percent up to about 5.0 percent lauric diethanolamide; from about 1.0 percent up to about 5.0 percent sodium lauroyl sarcosinate; from about 10.0 percent up to about 20.0 percent glycerine; from about 0.2 percent up to about 0.4 percent of a reagent selected from the group consisting of hydroxyethylene diaminotetraacetic acid, trisodium salt of ethylene diaminotetraacetic acid and mixtures thereof; about 1.0 percent of an antioxidant selected from the group consisting of butylated hydroxyanisole, butylated hydroxytoluene α-tocopherol and mixtures thereof; from about 6.0 percent up to about 10.0 percent of an iodophore; and the balance being citric acid to provide the composition a pH of at least 8.6 and not more than 8.8.

2. An antibacterial soap composition according to claim 1 in which said iodophore is povidone-iodine.

3. An antibacterial soap composition for molding into a bar consisting essentially of, in weight percent: 14.25 hydrogenated tallow; 8.1 caustic soda; 6.2 distilled water; 33.4 triethanolamine; 20.5 isostearic acid; 3.5 coco diethanelamide; 10.0 glycerine; 0.05 α-tocopherol; and 4.0 povidone-iodine.

4. The method of producing an aqueous antibacterial soap composition capable of delivering an iodophore as an active germicide while maintaining the gentleness associated with fatty acid soaps comprising of the steps of: admixing in a vessel heated to 60° C. from 4 to 8 W/W percent of isostearic acid, 3 to 10 W/W percent n-dodecanoic acid, and 1 to 5 W/W percent of stearic acid with a stoichiometric amount of an alkali selected from the group consisting of caustic soda or sodium hydroxide until the acids are balanced therewith; stirring from 2 to 4 W/W percent of triethanolamine as solubilizer into the heated balanced mixture and adding from 40 to 50 W/W percent distilled water; cooking said balanced solubilized water mixture with stirring for 30 minutes at 60° C. to produce a homogeneous cooked mixture; adding to said homogeneous cooked mixture from about 1 to 5 W/W percent sodium N-methyl taurate, from about 1 to 5 W/W percent lauric diethanolamide, from about 1 to 5 percent sodium lauroyl sarcosinate, and about 5 to 15 W/W percent glycerine while stirring; thereafter adding about 0.3 W/W percent of a chelating agent and about 1.0 W/W percent of an antioxidant with continuous stirring to form a homogeneous blend; cooling the homogeneous blend while continuing stirring to 40° C.; thereafter adding from about 6.0 to 10.0 W/W percent of an iodophore to the cooled blend; adding sufficient citric acid to the cooled blend to adjust the pH of the blend into the range of 8.6 to 8.8; and packaging the pH adjusted blend.

5. The method according to claim 4 in which said iodophore is povidone-iodine.

6. The method of claim 4 in which said pH adjusted blend is packaged as a liquid.

* * * * *